US007357386B2

(12) United States Patent
Shikan et al.

(10) Patent No.: US 7,357,386 B2
(45) Date of Patent: Apr. 15, 2008

(54) DEVICE AND METHOD FOR FEEDING PAPER

(75) Inventors: Mitsuhiro Shikan, Uchinada-machi (JP); Masaaki Yamashita, Kanazawa (JP); Takumi Nakayama, Tsubata-machi (JP); Satoshi Ishida, Kanazawa (JP)

(73) Assignee: PFU Limited, Ishikawa (JP)

( * ) Notice: Subject to any disclaimer, the term of this patent is extended or adjusted under 35 U.S.C. 154(b) by 422 days.

(21) Appl. No.: 10/536,989

(22) PCT Filed: Mar. 9, 2004

(86) PCT No.: PCT/JP2004/003035

§ 371 (c)(1),
(2), (4) Date: May 31, 2005

(87) PCT Pub. No.: WO2004/080863

PCT Pub. Date: Sep. 23, 2004

(65) Prior Publication Data

US 2006/0097441 A1 May 11, 2006

(30) Foreign Application Priority Data

Mar. 12, 2003 (JP) ..... 2003-066021

(51) Int. Cl.
*B65H 5/00* (2006.01)

(52) U.S. Cl. ..... 271/10.09; 271/114; 271/117; 271/121; 271/241

(58) Field of Classification Search ..... 271/10.09, 271/10.11, 114, 117, 118, 121, 124, 241
See application file for complete search history.

(56) References Cited

FOREIGN PATENT DOCUMENTS

| | | |
|---|---|---|
| JP | 61-081330 | 4/1986 |
| JP | 3-12824 | 2/1991 |
| JP | 03-211123 | 9/1991 |
| JP | 08-002700 | 1/1996 |
| JP | 08-058987 | 3/1996 |
| JP | 10-035897 | 2/1998 |
| JP | 11-334919 | 12/1999 |
| JP | 2000-143001 | 5/2000 |

OTHER PUBLICATIONS

Kitahara Mokoto, "Sheet Feeding Device", Publication No. 60040337, Publication Date: Mar. 2, 1985, vol. 9, No. 168.
Sakuragi Kenkichi, "Sheet Feeder", Publication No. 60026534, Publication Date: Feb. 9, 1985, vol. 9, No. 149.
Supplementary European Search Report, dated May 10, 2006.

*Primary Examiner*—David H Bollinger

(57) ABSTRACT

A paper feed apparatus of the present invention includes a pick mechanism for successively taking out, by use of a pick roller 1, a plurality of sheets of paper stacked on a chute from the bottom side thereof, leading ends of the sheets being aligned by means of a stopper block 2 in a state in which the sheets are stacked on the chute. Moreover, the apparatus includes a roller guide 11 and an abutment guide 12. When the roller guide 11 is raised to a paper setting position in a direction away from the pick roller 1, the roller guide 11 raises the leading ends of the sheets stacked on the chute to thereby prevent contact between the sheets and the pick roller 1. The abutment guide 12 aligns the leading ends of the sheets when the roller guide 11 is raised. When a pick operation is started, prior to retraction of the roller guide 11, sheet pressing operation of a pick arm 4 and retraction of the abutment guide 12 are performed, and then the sheets are taken out through a clearance formed between the distal end of the stopper block 2 and the pick roller 1.

6 Claims, 7 Drawing Sheets

PICK MECHANISM (PAPER SETTING POSITION)

PICK MECHANISM (PICK OPERATION START POSITION)

(A) EXAMPLE OF ABUTMENT GUIDE HAVING ROUGHENED AREA (B) EXAMPLE OF ABUTMENT GUIDE HAVING STEPPED AREA

CONVENTIONAL PICK MECHANISM

DEVICE AND METHOD FOR FEEDING PAPER

TECHNICAL FIELD

The present invention relates to a bottom-take-out-scheme paper feed technique employed in, for example, an image reader apparatus having an automatic paper feed apparatus, and in particular, to a paper feed apparatus and method which eliminate the necessity of special pre-operation at the time of paper setting, to thereby improve operability.

BACKGROUND ART

Conventionally, there has been known a technical idea of successively taking out a plurality of sheets of paper stacked on a chute from the bottom side by use of a pick roller and a separation pad (see, for example, Patent Document 1).

Patent Document 1: Japanese Patent Application Laid-Open (kokai) No. 2000-143001

Here, the definitions and technical backgrounds of the following terms used in relation to the present invention will be described in order to clarify their comprehensive concepts.

"Regular direction" and "reverse direction" are defined as directions in which an object is moved. In an original-conveyance-type image reader apparatus, "regular direction" is defined as a conveyance direction in which an original sheet supplied to the image reader apparatus is conveyed to pass through an image reading line and is then discharged. Accordingly, the direction of rotation of a pick roller at the time of taking out a sheet of paper stacked on a chute and the direction of rotation of a feed roller for conveying the sheet in the regular direction are defined as the regular rotational direction.

"Reverse direction" is a direction opposite the regular direction. Accordingly, with regard to the rotational directions of the pick roller and the feed roller, a rotational direction opposite the regular rotational direction is defined as the reverse rotational direction.

Similarly, with regard to the rotational directions of a pick motor for imparting drive force to the pick roller and the rotational directions of a feed motor for imparting drive force to the feed roller, drive in the regular direction and drive in the reverse direction are defined on the basis of the above definitions.

FIG. 7 shows an image reader apparatus equipped with a conventional paper feed apparatus described in the above-mentioned Patent Document 1. The illustrated apparatus is an original-conveyance-type image reader apparatus having a housing structure that can be divided into an upper housing and a lower housing. The image reader apparatus has a chute 16, which is provided at the rear and on which an original to be read is stacked, and also has a paper feed apparatus inside the housing. The paper feed apparatus takes out sheets of paper form the chute 16 one sheet at a time, conveys the sheets to reading mechanisms, and discharges them to the outside the apparatus after the sheets are read.

A pick mechanism of the paper feed apparatus shown in a circle of FIG. 7 is formed in the vicinity of a sheet feed port of the chute 16, takes out sheets of paper one sheet at a time, and conveys the sheets to a pair of feed rollers 7. The feed rollers 7 convey each sheet to reading mechanisms (front-face reading mechanism, and reverse-face reading mechanism). Immediately before reaching the reading mechanisms, a leading end of each sheet is detected by means of a detection sensor, and reading operation is started in response to a signal from the detection sensor. Subsequently, when the detection sensor detects a trailing end of the sheet, the reading operation is ended, and the sheet is discharged to an unillustrated stacker by means of discharge rollers 15.

The pick mechanism according to the conventional technique will be further described with reference to FIG. 6, which shows the detail structure of the pick mechanism. As shown in FIG. 6, the pick mechanism includes a pick roller 1, a stopper block 2, a separation pad 3, and a pick arm 4; and provides a function of taking out sheets, one sheet at a time, from a chute on which sheets of paper 5 are loaded.

The pick roller 1 and the stopper block 2 face each other with a proper clearance formed therebetween, so that only a small number of sheets 5 can pass through the clearance. Conveyance of the remaining sheets is prevented, with their leading ends blocked by means of the stopper block 2.

The separation pad 3 is in contact with the pick roller 1. The small number of sheets 5 having passed through the clearance between the pick roller 1 and the stopper block 2 are separated by means of the separation pad 3 in contact with the pick roller 1, so that only a single sheet is conveyed.

The single sheet 5 separated by means of the separation pad 3 further advances, and reaches the feed rollers 7, so that the sheet is conveyed at a conveyance speed of the feed rollers 7.

As described above, the plurality of sheets of paper 5, whose stacking condition on the chute has been corrected by means of the stopper block 2, are pressed against the pick roller 1 by means of the pick arm 4, so that the pick roller 1 generates frictional drive force. Accordingly, when the pick roller 1 rotates in the regular direction, a small number of bottom sheets 5 are taken out and passed through the clearance between the pick roller 1 and the stopper block 2, and advancement of excess sheets is prevented by means of the separation pad 3.

DISCLOSURE OF THE INVENTION

As described above, the leading ends of the plurality of sheets 5 stacked on the chute are aligned along the stopper block 2. However, when a small number of sheets 5 are stacked on the chute, the lowermost sheet 5 receives a load of friction with the pick roller 1, so that the sheets do not abut the stopper block 2 and enter the clearance between the pick roller 1 and the stopper block 2, or the stacking orientation of the sheets inclines with respect to the conveyance direction (that is, the trailing ends of sheets lift), which makes accurate positioning of sheets 5 and setting the orientation thereof difficult.

The present invention was accomplished to solve the above-mentioned problem, and an object of the present invention is to enable accurate positioning of sheets and setting the orientation thereof when the sheets are stacked on a chute.

A paper feed apparatus of the present invention includes a pick mechanism for successively taking out, by use of a pick roller, a plurality of sheets of paper stacked on a chute from the bottom side thereof, leading ends of the sheets being aligned by means of a stopper block in a state in which the sheets are stacked on the chute. Moreover, the apparatus includes a roller guide and an abutment guide. When the roller guide is raised to a paper setting position in a direction away from the pick roller, the roller guide raises the leading ends of the sheets stacked on the chute to thereby prevent contact between the sheets and the pick roller. The abutment guide aligns the leading ends of the sheets, which ends have been raised by means of the raised roller guide. When a pick operation is started, prior to retraction of the roller guide, sheet pressing operation of a pick arm and retraction of the abutment guide are performed, and then the sheets are taken out through a clearance formed between the distal end of the stopper block and the pick roller.

A paper feed method of the present invention is adapted to successively take out, by use of a pick roller, a plurality of sheets of paper stacked on a chute from the bottom side thereof, leading ends of the sheets being aligned by means of a stopper block in a state in which the sheets are stacked on the chute. The method comprises the steps of preventing contact between the sheets and the pick roller by means of a roller guide which raises the leading ends of the sheets stacked on the chute when the roller guide is raised to a paper setting position in a direction away from the pick roller; and aligning, by use of an abutment guide, the leading ends of the sheets, which ends have been raised by means of the raised roller guide. When a pick operation is started, prior to retraction of the roller guide, sheet pressing operation of a pick arm and retraction of the abutment guide are performed, and then the sheets are taken out through a clearance formed between the distal end of the stopper block and the pick roller.

By employment of the above-described means, the paper feed apparatus of the present invention can align leading ends of sheets of paper when they are stacked on the chute.

Further, the roller guide may be moved to the paper setting position through drive of the pick roller in the reverse direction, and the roller guide may be moved to a retreat position through drive of the pick roller in the regular direction. This enables a drive source for paper feed operation to be used as a drive source for preparing a state for sheet alignment.

The roller guide may be moved upward and downward before start of paper feed operation so as to impart vertical vibration to the sheets to be fed, to thereby align the sheets before start of the paper feed operation.

Further, a feed motor for driving the feed roller may move the abutment guide to a paper setting position through drive of the feed roller in the reverse direction, and move the abutment guide to a retreat position through drive of the feed roller in the regular direction. This enables a drive source for paper feed operation to be used as a drive source for preparing a state for sheet alignment by means of the abutment guide.

Moreover, a portion of the abutment guide which comes into contact with leading ends of sheets of paper may be roughened. In this case, the abutment guide can fix the abutting leading ends of the sheets, while suppressing rising of the leading ends of the sheets.

Retraction of the abutment guide and sheet pressing operation of the pick arm may be started prior to retraction of the roller guide in order to start paper feed operation after cancellation of the state prepared for sheet alignment at the time of sheet stacking.

BEST MODE FOR CARRYING OUT THE INVENTION

Figure 1:
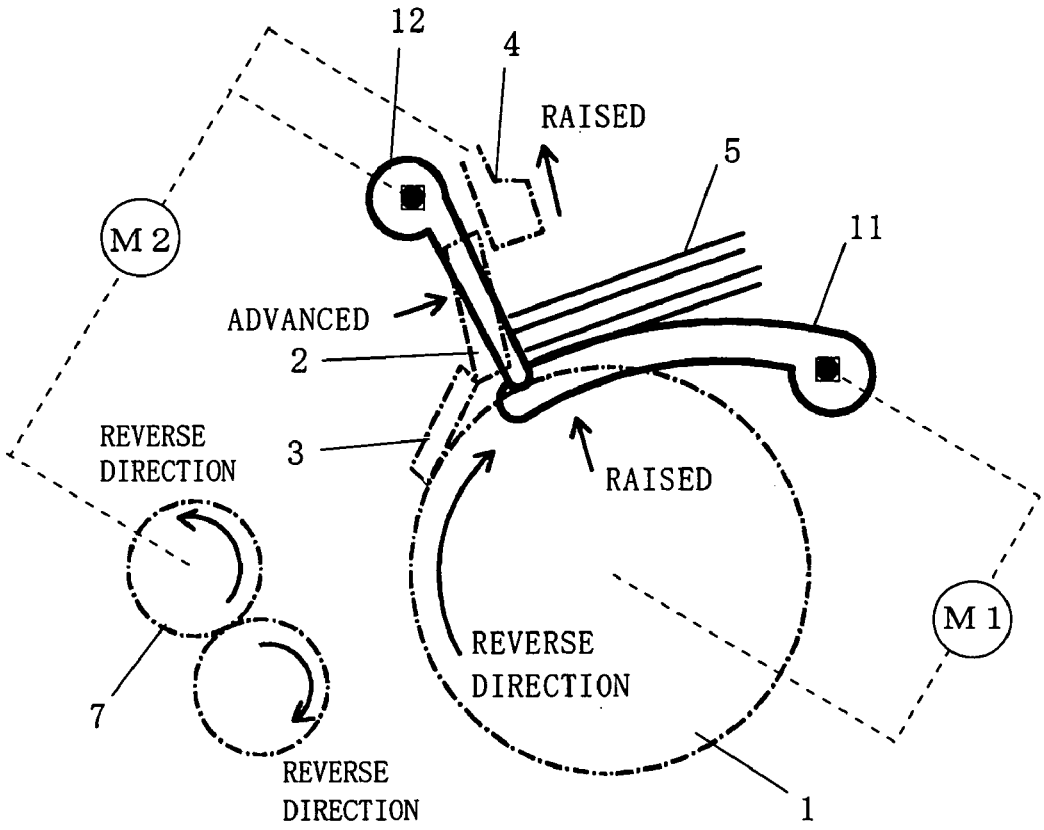
FIG. 1 is a view illustrating a pick mechanism of a paper feed apparatus according to an embodiment of the present invention.
Figure 7:
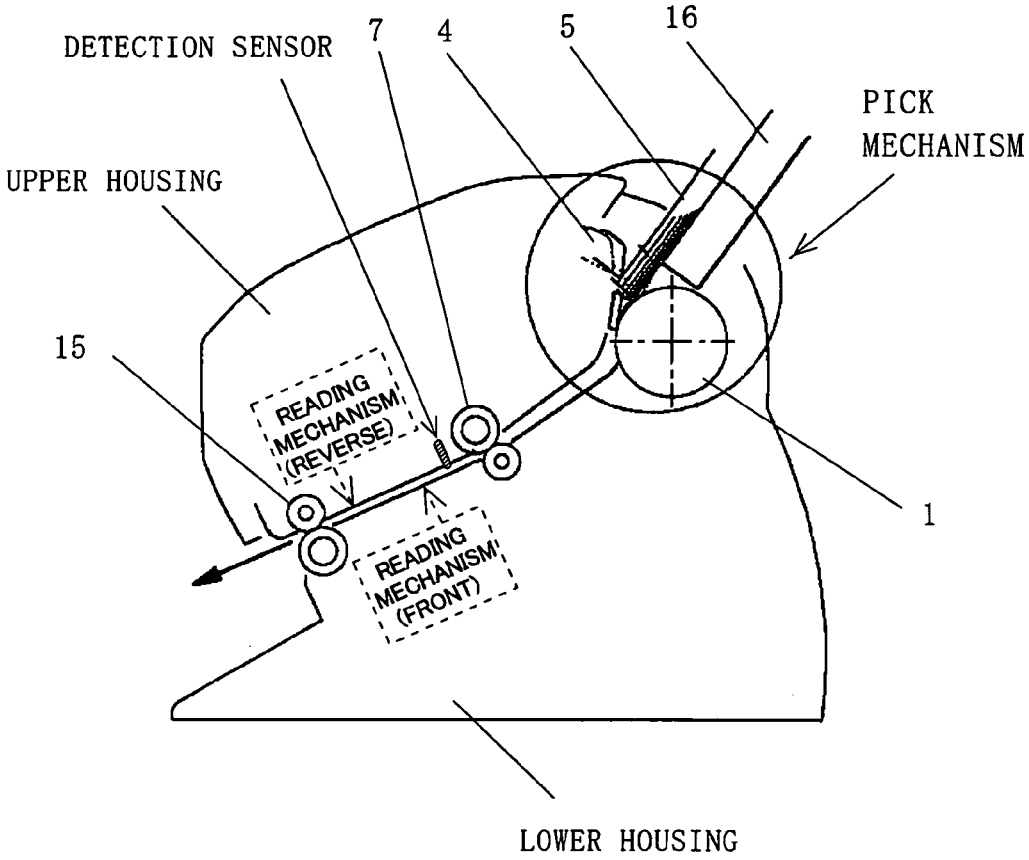
FIG. 7 is an overall schematic view of an image reader apparatus equipped with a conventional paper feed apparatus.

FIG. 1 is a view illustrating a pick mechanism of a paper feed apparatus according to an embodiment of the present invention. The feature of the paper feed apparatus according to the present invention resides in the pick mechanism of the paper feed apparatus. An image reader apparatus, to which the paper feed apparatus is attached, itself may have a conventional structure as having been described with reference to FIG. 7. That is, the paper feed apparatus according to the present invention can be attached to an original-conveyance-type image reader apparatus having a housing structure that can be divided into an upper housing and a lower housing. The image reader apparatus has a chute which is provided at the rear of the housing and on which an original to be read is set, and also has a paper feed apparatus inside the housing. The paper feed apparatus takes out sheets of paper form the chute one sheet at a time, conveys the sheets to reading mechanisms (front-face reading mechanism, and reverse-face reading mechanism), and discharges them to the outside of the apparatus after the sheets are read.

The sheets taken out, one sheet at a time, by means of the pick mechanism of the paper feed apparatus, by which the present invention is characterized, are conveyed to a pair of feed rollers 7. Subsequently, in the same manner as in FIG. 7, each sheet is conveyed by means of the feed rollers 7 to the reading mechanisms (front-face reading mechanism, and reverse-face reading mechanism). Immediately before reaching the reading mechanisms, a leading end of each sheet is detected by means of a detection sensor, and reading operation is started in response to a signal from the detection sensor. Subsequently, when the detection sensor detects a trailing end of the sheet, the reading operation is ended, and the sheet is discharged by means of discharge rollers.

Next, the structure and operation of the pick mechanism of the paper feed apparatus, by which the present invention is characterized, will be described with reference to FIG. 1. Notably, the illustrated pick mechanism in a "paper setting position" is later driven to a "pick operation start position" shown in FIG. 2. The illustrated paper feed apparatus is equipped with a pick mechanism which successively takes out a plurality of sheets 5 stacked on the chute from the bottom side thereof, and moves each fed sheet to a standby position. In FIG. 1, reference numeral 1 denotes a pick roller; 2 denotes a stopper block; 3 denotes a separation pad; and 4 denotes a pick arm; and 7 denotes the pair of feed rollers for receiving and conveying each sheet. The stopper block 2, the separation pad 3, and the pick arm 4 are held on a member which differs from a member supporting the pick roller 1 and which is opened and closed with respect to the latter member. For example, as having been described with reference to FIG. 7, the stopper block 2, the separation pad 3, and the pick arm 4 are held on the upper housing; and the pick roller 1 is held on the lower housing. This configuration enables cancellation of contact between the pick roller 1 and the separation pad 3 when necessary.

The stopper block 2 blocks, by means of its side face, the leading ends of the sheets stacked on the chute, and forms a predetermined clearance between the distal end of the stopper block 2 and the pick roller 1. The separation pad 3 picks, one sheet at a time, the sheets which are placed in the standby position in sliding contact with the pick roller 1. The pick arm 4, which is located in an upper position during a standby period (when sheets of paper are set), is driven to move to a lower position at the time of paper feed. By means of an unillustrated pressure application element, pressure is applied to the pick arm 4, whereby the sheets stacked on the chute is pressed from above in a region in the vicinity of the sheet supply port of the chute. With the structure described above, the paper feed apparatus successively takes out the plurality of sheets stacked on the chute from the bottom, and feeds them to a paper feed passage, one sheet at a time.

Figure 6:
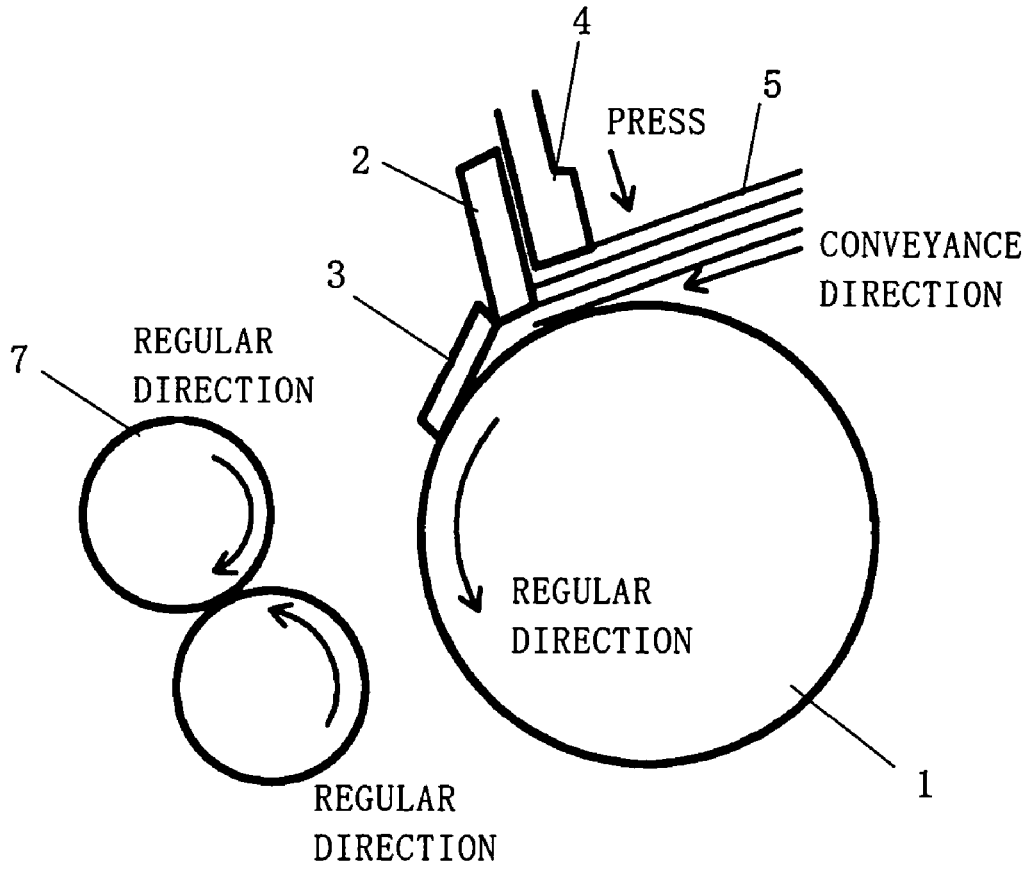
FIG. 6 is a view showing the details of a conventional pick mechanism shown in FIG. 7.

The above-described structure may be identical with the conventional structure having been described with reference to FIG. 6. However, the apparatus illustrated in FIG. 1 further includes a roller guide 11 and an abutment guide 12. These guides are each formed of a plate member which rotates about one end thereof so as to swing the other end (hereinafter may be referred to as "distal end") clockwise and counterclockwise. These guides are provided at one or both of sides with respect to the width direction of sheets of paper.

When the roller guide 11, which is provided on the lateral side of the pick roller 1 and in the vicinity thereof, is operated, the distal end of the roller guide 11 is stopped at a position above the pick roller 1 so as to break the contact between the sheets 5 and the pick roller 1. Power necessary for driving the roller guide 11 is obtained, via a proper power transmission system, from a drive motor M1, which drives the pick roller 1.

As shown in FIG. 1, the drive motor M1 for the pick roller 1 imparts a rotational drive force in the reverse direction to the pick roller 1 via an appropriate gear train or the like (not shown), and simultaneously raises the roller guide 11 via a cam or the like. The position to which the roller guide 11 is raised will be referred to as a "paper setting position" of the roller guide 11.

Similarly, a drive motor M2 for driving the feed rollers 7 raises the pick arm 4 via an appropriate gear train or the like (not shown).

Moreover, the motor M2 for the feed rollers 7 advances the abutment guide 12 via an appropriate gear train or the like (not shown), so that the sheets of paper abut the distal end portion of the abutment guide 12. The position to which the abutment guide 12 is advanced will be referred to as a "paper setting position" of the abutment guide 12.

When the roller guide 11 and the abutment guide 12 are in their paper setting positions, the leading end portions of the sheets 5 stacked on the chute are positioned by means of the roller guide 11 and the abutment guide 12, and the sheets do not come into contact with the pick roller 1. Therefore, an operation of striking sheets of paper against the abutment guide can be performed, while preventing misalignment of the leading ends of the sheets, which misalignment would otherwise occur due to contact resistance at the time of setting the sheets.

Figure 2:
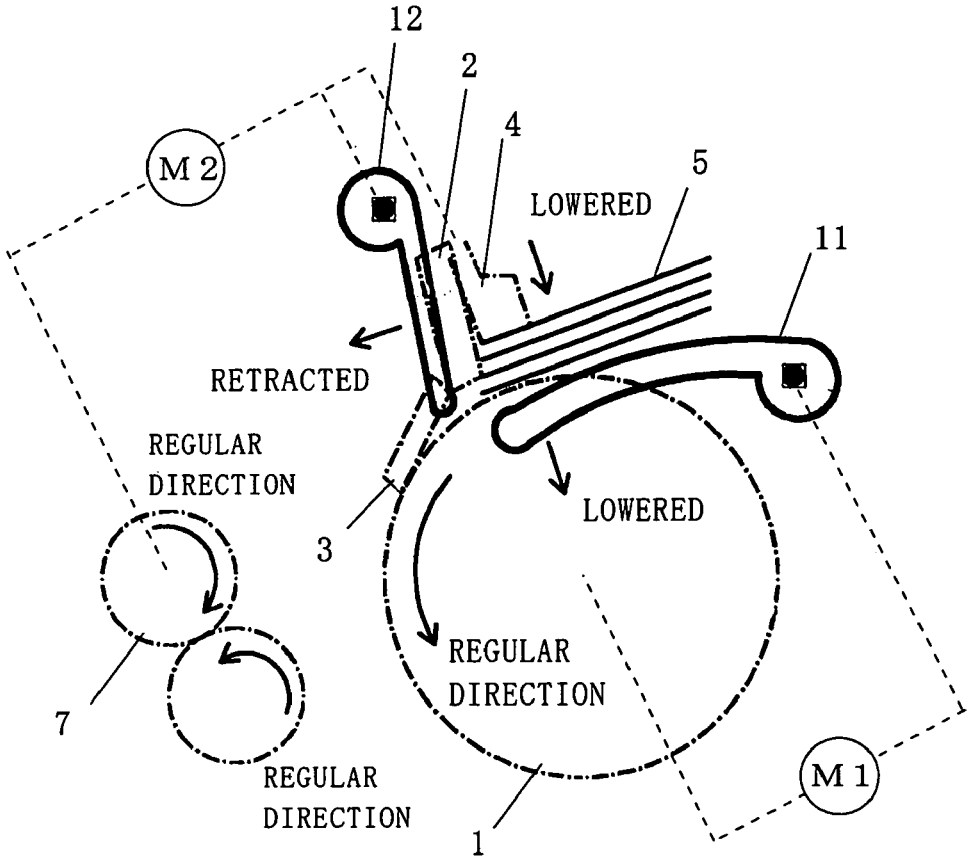
FIG. 2 is a view for explaining drive of the pick mechanism to a "pick operation start position."

Next, drive of the pick mechanism to the "pick operation start position" will be described with reference to FIG. 2. As shown in FIG. 2, the drive motor M1 for the pick roller 1 imparts a rotational drive force in the regular direction to the pick roller 1 via an appropriate gear train or the like (not shown), and simultaneously lowers the distal end of the roller guide 11 via a cam or the like. The position to which the distal end of the roller guide 11 is lowered will be referred to as a "retreat position" of the roller guide 11.

Similarly, the drive motor M2 for the feed rollers 7 lowers the pick arm 4 via an appropriate gear train or the like (not shown).

Moreover, the motor M2 for the feed rollers 7 retracts the distal end of the abutment guide 12 via an appropriate gear train or the like (not shown), so that the abutment guide 12 is separated from the leading ends of the sheets 5. The position to which the abutment guide 12 is retreated so as to separate its distal end from the leading ends of the sheets 5 will be referred to as a "retreat position" of the abutment guide 12.

Since the roller guide 11 and the abutment guide 12 are in their retreat positions, the leading end portion of the lowermost sheet among the sheets 5 stacked on the chute comes into contact with the pick roller 1, and receives a frictional drive force generated upon pressing by the pick arm 4, whereby pick operation is started.

Figure 3:
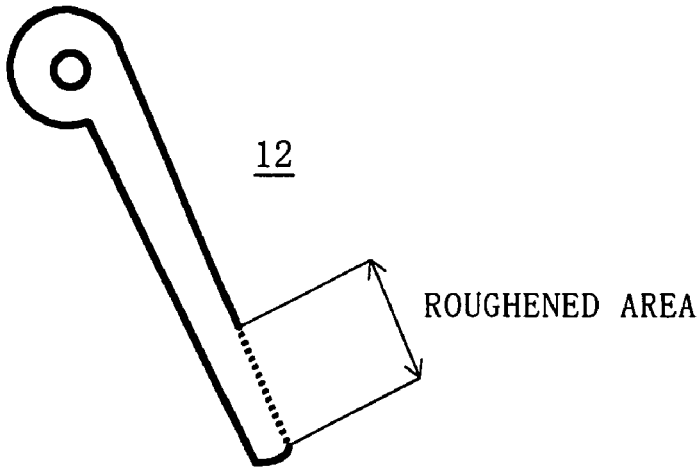
FIG. 3 is a pair of views each illustrating the structure of an abutment guide.
Figure 3:
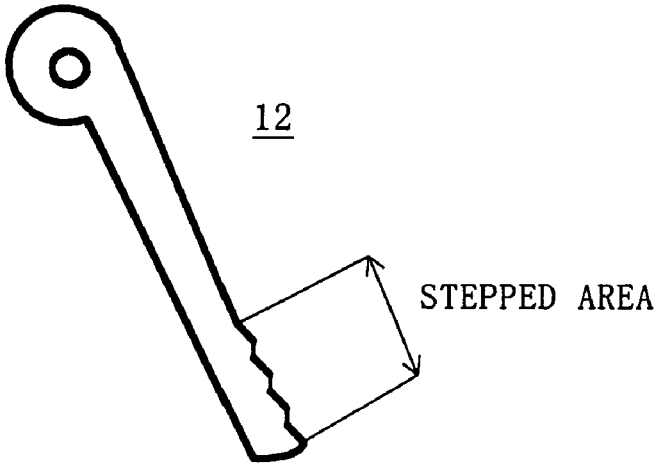

As shown in FIG. 3(A), a face of the abutment guide 12 which comes into contact with the leading ends of sheets has a roughened surface. Since the leading ends of the stacked sheets of paper are held by means of the roughened surface, the leading ends of the sheets are prevented from curling upward. This prevents the failure of a sheet to be picked because of engagement with the abutment guide 12 at the start of pick operation.

As shown in FIG. 3(B), the abutment guide 12 may have a stepped surface instead of a roughened surface.

Figure 4:
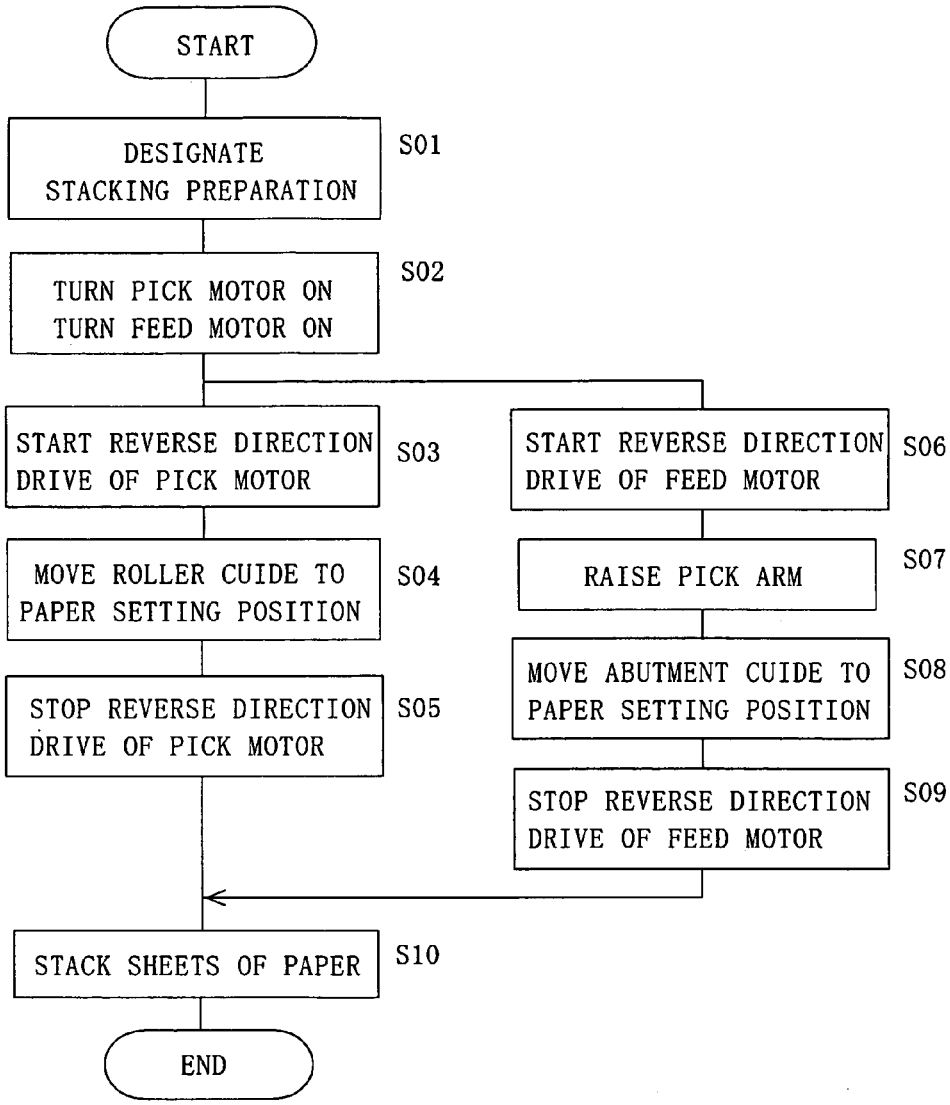
FIG. 4 is a flowchart showing the steps of operation performed by the paper feed apparatus so as to align leading ends of sheets stacked on a chute.

The control procedure performed by a paper feed apparatus according to a representative example of the present invention will be described with reference to FIGS. 4 and 5. FIG. 4 is a flowchart showing the steps of operation performed by the paper feed apparatus so as to align leading ends of sheets stacked on the chute. Reference numerals used in the description of individual steps of the procedures correspond to those shown in FIG. 1.

When stacking preparation (e.g., immediately after power is turned on or after discharge of sheets read in a previous cycle) is designated in step S01, the apparatus proceeds to step S02 so as to turn on a pick motor (not shown) for driving the pick roller and a feed motor (not shown) for driving the feed rollers.

In step S03, the pick motor starts rotation in the reverse direction so as to start drive of the pick roller 1 in the reverse direction.

In step S04, the pick motor raises the roller guide 11 via a power transmission system composed of an appropriate gear train, so that the roller guide 11 moves to the paper setting position.

In step S05, the apparatus stops drive of the pick motor.

Meanwhile, in step S06, the feed motor starts rotation in the reverse direction so as to start drive of the feed rollers 7 in the reverse direction.

In step S07, the feed motor raises the pick arm 4 via a power transmission system composed of an appropriate gear train. In step S08, the feed motor advances the abutment guide 12, so that the abutment guide 12 moves to the paper setting position.

In step S09, the apparatus stops rotation of the feed motor in the reverse direction.

In step S10, sheets of paper 5 are stacked on the chute. At this time, in the paper feed apparatus, the sheet-end alignment mechanism composed of the roller guide 11 and the abutment guide 12 is activated so as to align the leading ends of the sheets.

Specifically, the leading ends of the sheets 5 are blocked by means of the roller guide 11 and the abutment guide 12, and maintained in an aligned state, so that they do not enter the clearance between the pick roller 1 and the stopper block 2.

Figure 5:
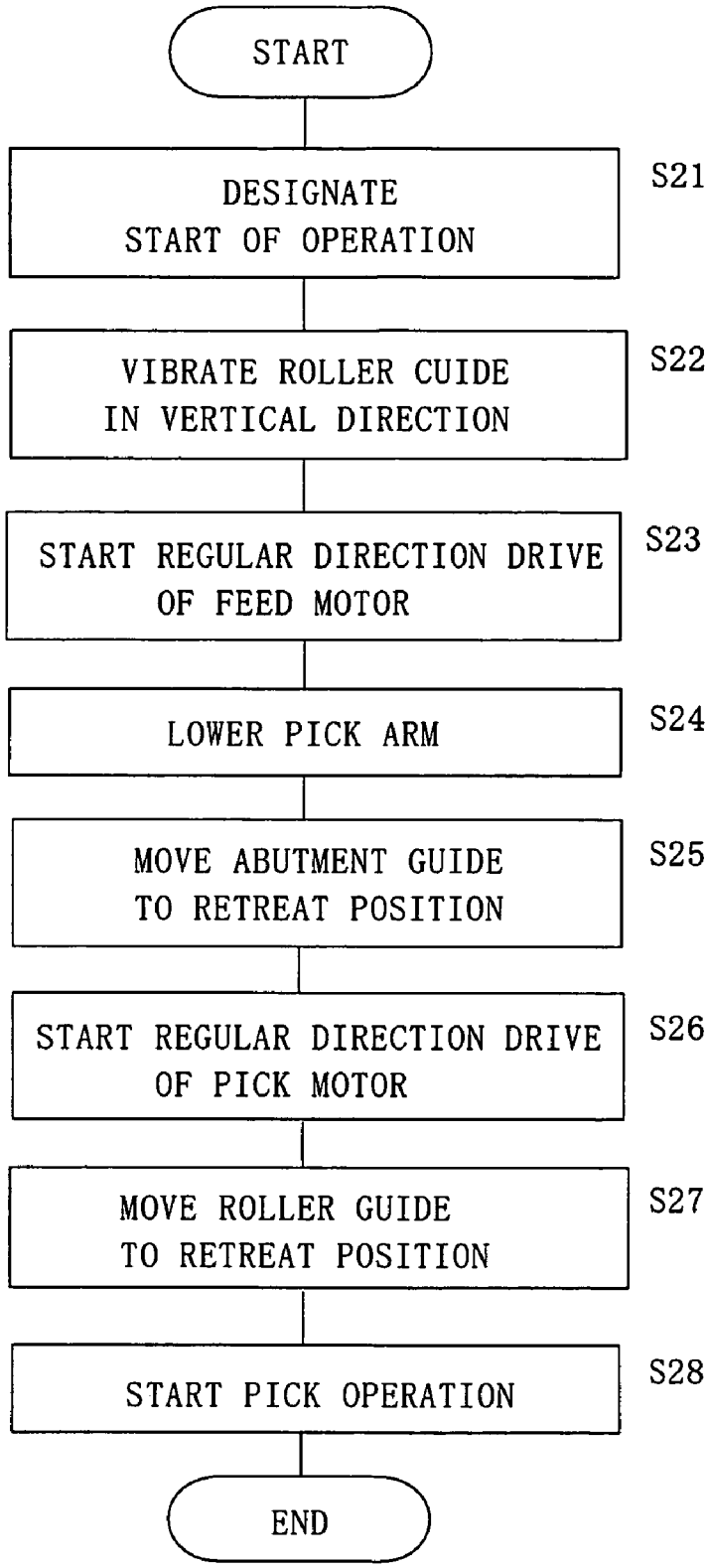
FIG. 5 is a flowchart showing the steps of operation performed by the paper feed apparatus so as to feed the sheets stacked on the chute.

FIG. 5 is a flowchart showing the steps of operation performed by the paper feed apparatus so as to feed the sheets stacked on the chute. Reference numerals used in the description of individual steps of the procedures correspond to those shown in FIG. 2.

In step S21, the apparatus designates start of paper pick operation. The apparatus then proceeds to step S22 so as to shake the roller guide 11 in the vertical direction by use of a shaking mechanism (not shown) incorporated in the drive system for the roller guide 11.

This shaking operation performed by means of the dedicated shaking mechanism may be replaced with vertical movement of the roller guide 11 performed by means of the pick roller.

In step S23, the feed motor starts rotation in the forward direction.

In step S24, the feed motor lowers the pick arm 4 by means of its drive force in the regular direction transmitted via a power transmission system composed of an appropriate gear train.

In step S25, the feed motor retracts the abutment guide 12 to the retreat position by means of its drive force in the regular direction transmitted via a power transmission system composed of an appropriate gear train.

In step S26, the pick motor starts rotation in the regular direction.

In step S27, the pick roller 1 starts rotation in the regular direction, and the roller guide 11 is lowered to the retreat position.

In step S28, the leading end of the lowermost sheet among the sheets 5 stacked on the chute comes into contact with the pick roller 1, and receives a frictional drive force generated upon pressing by the pick arm 4, whereby pick operation is started.

The invention claimed is:

1. A paper feed apparatus includes a pick mechanism for successively taking out, by use of a pick roller, a plurality of sheets of paper stacked on a chute from the bottom side thereof, leading ends of the sheets being aligned by means of a stopper block in a state in which the sheets are stacked on the chute, characterized by comprising:

a roller guide that is movable between a paper setting position and a retreat position and raises the leading ends of the sheets stacked on the chute to thereby prevent contact between the sheets and the pick roller, when the roller guide is raised to the paper setting position in a direction away from the pick roller; and an abutment guide for aligning the leading ends of the sheets, which ends have been raised by means of the raised roller guide, wherein when a pick operation is started, prior to retraction of the roller guide, sheet pressing operation of a pick arm and retraction of the abutment guide are performed, and then the sheets are taken out through a clearance formed between the distal end of the stopper block and the pick roller.

2. A paper feed apparatus according to claim 1, wherein the paper feed apparatus is disposed in an original-conveyance-type image reader apparatus having a housing structure that can be divided into an upper housing and a lower housing; the roller guide is attached to the lower housing; and the abutment guide is attached to the upper housing.

3. A paper feed apparatus according to claim 1, wherein the roller guide is mechanically linked with the pick roller so that the roller guide is moved to the paper setting position through drive of the pick roller in a reverse direction, and is moved to a retreat position through drive of the pick roller in a regular direction.

4. A paper feed apparatus according to claim 1, wherein the roller guide is moved upward and downward before start of paper feed operation so as to impart vertical vibration to the sheets to be fed, to thereby align the leading end of he sheets.

5. A paper feed apparatus according to claim 1, wherein a common drive source is used for a feed roller and the abutment guide so as to move the abutment guide to a paper setting position through drive of the feed roller in a reverse direction, and move the abutment guide to a retreat position through drive of the feed roller in a regular direction.

6. A paper feed apparatus according to claim 1, wherein a portion of the abutment guide which comes into contact with the leading ends of the sheets of paper has a roughened surface.

* * * * *

UNITED STATES PATENT AND TRADEMARK OFFICE

CERTIFICATE OF CORRECTION

PATENT NO. : 7,357,386 B2
APPLICATION NO. : 10/536989
DATED : April 15, 2008
INVENTOR(S) : Mitsuhiro Shikan et al.

It is certified that error appears in the above-identified patent and that said Letters Patent is hereby corrected as shown below:

Column 8, Line 33, change “he” to --the--.

Signed and Sealed this

Second Day of September, 2008

JON W. DUDAS
*Director of the United States Patent and Trademark Office*